US011994357B2

(12) United States Patent
Salinas

(10) Patent No.: US 11,994,357 B2
(45) Date of Patent: May 28, 2024

(54) TIMING, FASTENING, AND SEALING FEATURES FOR FIREARM GAS BLOCKS

(71) Applicant: AXTS INC, Redmond, OR (US)

(72) Inventor: Anibal Salinas, Redmond, OR (US)

(73) Assignee: AXTS, INC., Redmond, OR (US)

( * ) Notice: Subject to any disclaimer, the term of this patent is extended or adjusted under 35 U.S.C. 154(b) by 0 days.

(21) Appl. No.: 17/690,934

(22) Filed: Mar. 9, 2022

(65) Prior Publication Data

US 2022/0221238 A1 Jul. 14, 2022

Related U.S. Application Data

(63) Continuation-in-part of application No. 17/142,736, filed on Jan. 6, 2021, now Pat. No. 11,287,201.

(60) Provisional application No. 62/957,731, filed on Jan. 6, 2020.

(51) Int. Cl.
*F41A 5/26* (2006.01)
*F41A 5/28* (2006.01)

(52) U.S. Cl.
CPC ..... *F41A 5/28* (2013.01)

(58) Field of Classification Search
CPC ..... F41A 5/26; F41A 5/28
See application file for complete search history.

(56) References Cited

U.S. PATENT DOCUMENTS 1,388,879 A * 8/1921 Nelson ..... F41A 5/28 89/193
1,738,501 A 12/1929 Moore
2,341,680 A 2/1944 Williams
2,462,119 A * 2/1949 Moore ..... F41A 5/28 89/193
3,745,682 A * 7/1973 Waldeisen ..... F41B 11/85 42/106
4,109,403 A * 8/1978 Badali ..... F41A 21/484 42/75.02
4,244,273 A * 1/1981 Langendorfer, Jr ..... F41A 5/18 89/193
4,707,942 A * 11/1987 Peters ..... F41A 21/487 42/77
5,706,599 A * 1/1998 Knight ..... F41A 21/485 42/51
5,768,818 A * 6/1998 Rustick ..... F41A 5/26 89/193

(Continued)

OTHER PUBLICATIONS

Honey Badger, Barrel Assembly, as retrieved from URL <https://web.archive.org/web/20191219023420/https://www.liveqordie.com/products/honey-badger-barrel-assembly/>, Dec. 19, 2019, 10 pages.

(Continued)

*Primary Examiner* — Derrick R Morgan
(74) *Attorney, Agent, or Firm* — Schwabe Williamson & Wyatt

(57) ABSTRACT

A gas block assembly may include a gas block including a gas port to receive gas provided by a gas port of a barrel; a tapered fastener opening; and a tapered fastener insertable in the tapered fastener opening, the tapered fastener including: a length further including a tapered section to contact a sidewall that defines the tapered fastener opening; and means for rotationally driving the tapered fastener into the tapered fastener opening. In other embodiments, an adjustable gas block includes sealing ring(s) on a groove in a rotationally actuated gas metering shaft.

15 Claims, 13 Drawing Sheets

(56) References Cited

U.S. PATENT DOCUMENTS 5,824,943 A * 10/1998 Guhring ..... F41A 5/26 89/192
5,904,356 A * 5/1999 Mundy ..... F16J 15/4478 277/417
5,945,626 A 8/1999 Robbins
6,309,136 B1 * 10/2001 Kellenberger ..... F16D 1/094 403/374.3
6,487,805 B1 * 12/2002 Reynolds ..... F41A 21/485 42/75.03
6,848,351 B1 * 2/2005 Davies ..... F41C 23/16 89/193
7,309,187 B2 * 12/2007 Swanson ..... F16D 1/094 403/368
7,856,917 B2 12/2010 Noveske
7,891,284 B1 2/2011 Barrett
8,109,196 B1 * 2/2012 Spence ..... F41A 5/24 89/193
8,161,864 B1 4/2012 Vuksanovich
8,393,259 B2 3/2013 Larue
8,562,243 B2 * 10/2013 Dizdarevic ..... F16D 1/094 403/370
8,596,185 B1 * 12/2013 Soong ..... F41A 5/28 89/193
8,813,632 B2 * 8/2014 Adams ..... F41A 5/28 89/193
9,291,415 B1 * 3/2016 Beaty ..... F41A 5/28
9,335,106 B1 5/2016 Simon
9,372,039 B1 * 6/2016 Russo ..... F41A 5/28
9,410,756 B2 8/2016 Gardner et al.
9,464,865 B2 * 10/2016 Shea ..... F41C 23/16
9,671,184 B1 * 6/2017 Russo ..... F41A 5/28
9,869,521 B1 1/2018 Huang
10,197,348 B2 2/2019 DeSomma
10,436,549 B1 * 10/2019 Taylor ..... F41C 23/16
11,287,201 B1 * 3/2022 Underwood ..... F41A 5/26
11,506,460 B1 * 11/2022 Fuller ..... F41A 5/28
2009/0087258 A1 * 4/2009 McCabe ..... F16D 1/096 403/370
2010/0218671 A1 9/2010 Mayberry et al.
2010/0275770 A1 11/2010 Noveske
2010/0282066 A1 * 11/2010 Tankersley ..... F41G 11/003 42/108
2011/0023699 A1 2/2011 Barrett
2011/0179945 A1 7/2011 Clark et al.
2012/0180648 A1 * 7/2012 Sullivan ..... F41A 13/12 89/193
2013/0025445 A1 * 1/2013 Windauer ..... F41A 5/28 89/193
2013/0098235 A1 * 4/2013 Reinken ..... F41A 5/28 89/193
2014/0060312 A1 * 3/2014 Ruck ..... F41A 5/28 89/193
2014/0076143 A1 * 3/2014 Hall ..... F41A 19/03 89/129.01
2014/0076149 A1 * 3/2014 Adams ..... F41A 5/28 89/192
2014/0090550 A1 * 4/2014 Wilcox ..... F41A 5/28 89/193
2014/0190344 A1 * 7/2014 Kenney ..... F41A 5/28 89/193
2015/0176933 A1 6/2015 Adams
2015/0241149 A1 * 8/2015 McMillen, IV ..... F41A 5/28 89/193
2015/0253091 A1 * 9/2015 Gardner ..... F41A 5/20 89/193
2016/0084597 A1 3/2016 Ricks
2016/0091276 A1 * 3/2016 Miller ..... F41C 23/16 42/75.02
2016/0161200 A1 * 6/2016 Windauer ..... F41A 5/28 89/193
2016/0209138 A1 * 7/2016 DeSomma ..... F41A 5/28
2016/0265860 A1 9/2016 Schilling et al.
2016/0363406 A1 12/2016 Wiesblott et al.
2017/0045321 A1 * 2/2017 Larue ..... F41A 5/28
2017/0184367 A1 6/2017 Odle et al.
2017/0198995 A1 * 7/2017 Geissele ..... F41A 3/66
2018/0259278 A1 * 9/2018 Fleiner ..... F41A 5/26
2019/0017760 A1 1/2019 Schilling et al.
2019/0041147 A1 2/2019 Gardner
2019/0170461 A1 6/2019 Leitner-Wise
2019/0226802 A1 7/2019 Wheeler
2019/0242663 A1 * 8/2019 Miller ..... F41A 5/28
2019/0310037 A1 10/2019 Barton et al.
2019/0346223 A1 11/2019 Smith et al.
2020/0025477 A1 * 1/2020 Williams ..... F41A 3/66
2020/0025498 A1 1/2020 Wheeler
2020/0033084 A1 * 1/2020 Robinson ..... F41A 5/28
2020/0033085 A1 * 1/2020 Robinson ..... F41A 5/28
2020/0278165 A1 9/2020 Wheeler et al.
2020/0318920 A1 10/2020 Lynch
2021/0389066 A1 * 12/2021 Sylvester ..... F41A 5/26
2022/0099394 A1 * 3/2022 Gomez ..... F41A 5/28
2022/0307783 A1 * 9/2022 Puha ..... F41A 5/28

OTHER PUBLICATIONS

Modern Service Weapons, "Quick Look: Do It Yourself Pinned Gas Block", http://modernserviceweapons.com/?p=8597, May 28, 2014.
AR15.com, "[Archived Thread] Please help: front sight taper pins FUBR thanks to my gunsmith", https://www.ar15.com/forums/AR-15/Please-help-front-sight-taper-pins-FUBAR-thanks-to-my-gunsmith/118-761389/, Feb. 4, 2021.

* cited by examiner

TIMING, FASTENING, AND SEALING FEATURES FOR FIREARM GAS BLOCKS

PRIORITY

This application is a continuation-in-part of U.S. patent application Ser. No. 17/142,736, filed on Jan. 6, 2021, entitled ADJUSTABLE FIREARM GAS BLOCK, which claims priority to U.S. Provisional Application No. 62/957,731 filed on Jan. 6, 2020, entitled ADJUSTABLE FIREARM GAS BLOCK, each of which is incorporated by reference herein.

BACKGROUND

Typical firearms propel a bullet or other type of projectile through the expansion of gas within a firearm barrel. The majority of the gas may be expelled out of the front of the firearm barrel together with the bullet. However, some firearms may exploit a portion of the gas to automatically cycle the action of the firearm (e.g., "charge" the firearm), which may include ejecting the used casing and reloading another round of ammunition into the firing chamber. This portion of the gas may be expelled from a gas port located on the barrel. The expelled gas may be channeled by a gas tube back to the upper receiver so that it may be used to "charge" the firearm.

Some firearms may have a gas block located on the barrel to connect the gas port located on the barrel to the gas tube. This gas block, if positioned in a correct location on the length of the barrel during firearm assembly, and in a correct angular orientation, may prevent gas leaks and ensure that a sufficient amount of gas enters the tube to drive the action of the firearm. If the gas block is not positioned on the correct location or in a correct angular orientation during firearm assembly, an ingress port on an interior of the gas block may be partially misaligned with the gas port located on the barrel. This partial misalignment may reduce the amount of gas entering the gas tube, which could cause other firearm components to regularly or intermittently cycle incorrectly when fired (leading to regular or intermittent jams during firing). Since the gas block covers the gas port located on the barrel, both the gas port and the ingress port on the interior of the gas block are hidden from view once the gas block is slipped over the barrel, which makes positioning the gas block in the correct angular orientation difficult.

DETAILED DESCRIPTION

Timing System for Firearm Gas Block

A shoulder may be formed behind a location for a gas block by selectively removing material when the barrel is machined, and this shoulder fixes the position of the gas block in the lengthwise position. However, known shoulders do not prevent mis-timing the gas block (say, a wrong angular orientation in which gas flow is significantly impeded). As a result, firearm manufacturers may use a tool called a jig to time the gas block (to achieve the required orientation). When using the jig, the barrel is installed in the upper receiver, and then the jig is used to position the gas block relative to the upper receiver (the jig is used to time the gas block). With the gas block timed, pinning holes can then be drilled through the gas block and partially into the barrel, pins can be inserted into the pinning holes, so that the position of the gas block is fixed before removing the jig.

The use of the jig to time the gas block requires significant additional labor to assemble the firearm, raising manufacturing costs. One jig-less manufacturing method uses screws in place of pins. An attempt is made to predrill shallow template "dimple" in the barrel (on the gas block journal on which the gas block is to be slide over) before sliding on the gas block. The challenge comes from trying to align screw tips of screws used to fasten the gas block to the barrel into the predrilled shallow holes in barrel without the benefit of sight. Without experience on the part of the installer, due to the lack of visibility in attempting to find a template obscured by the gas block, a person could mistake the screw tip biting into the surface of the barrel for finding the template, and thus secure the gas block in a misoriented position.

Figure 1:
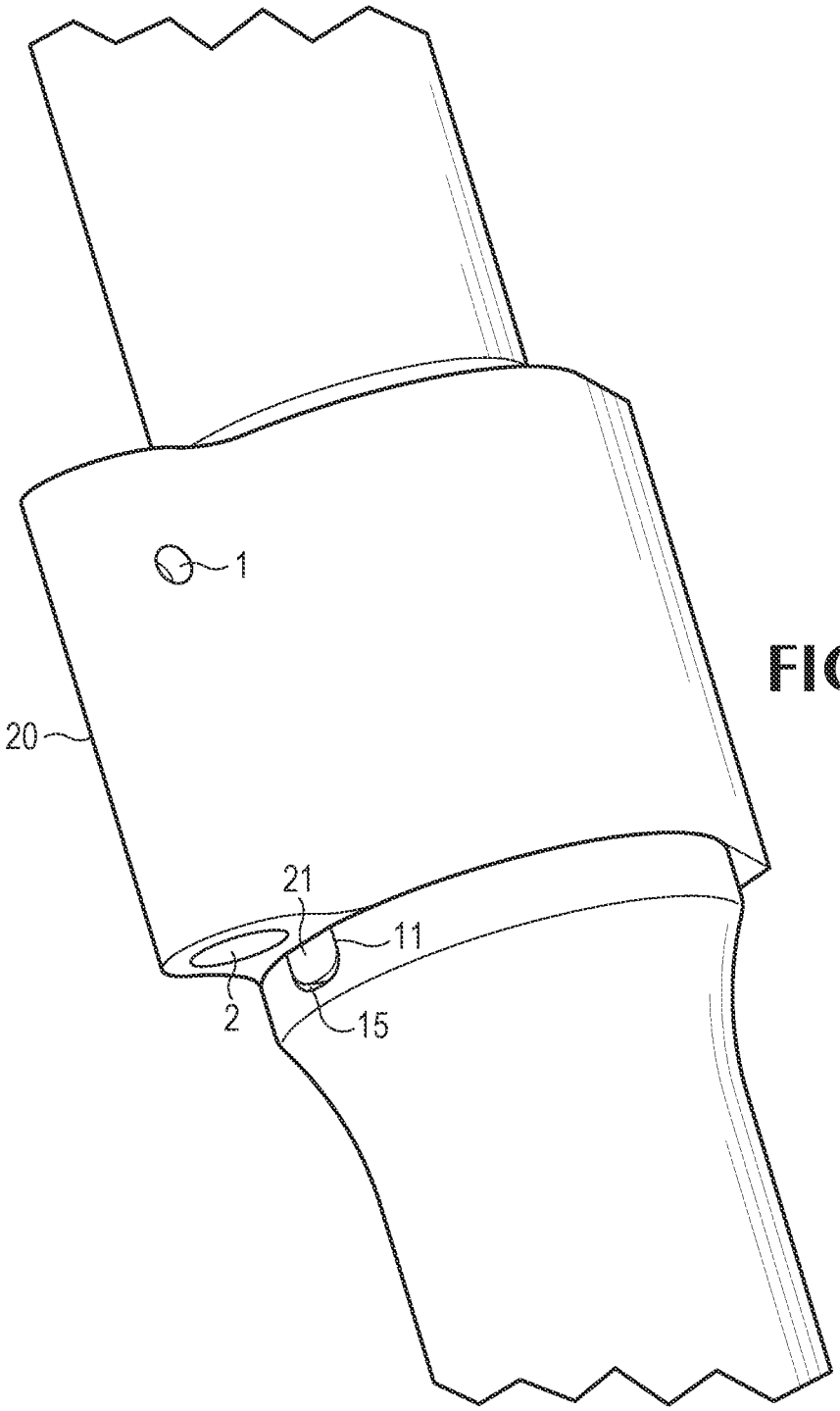
FIG. 1 illustrates a timing system for a firearm gas block, according to various embodiments.
Figure 2:
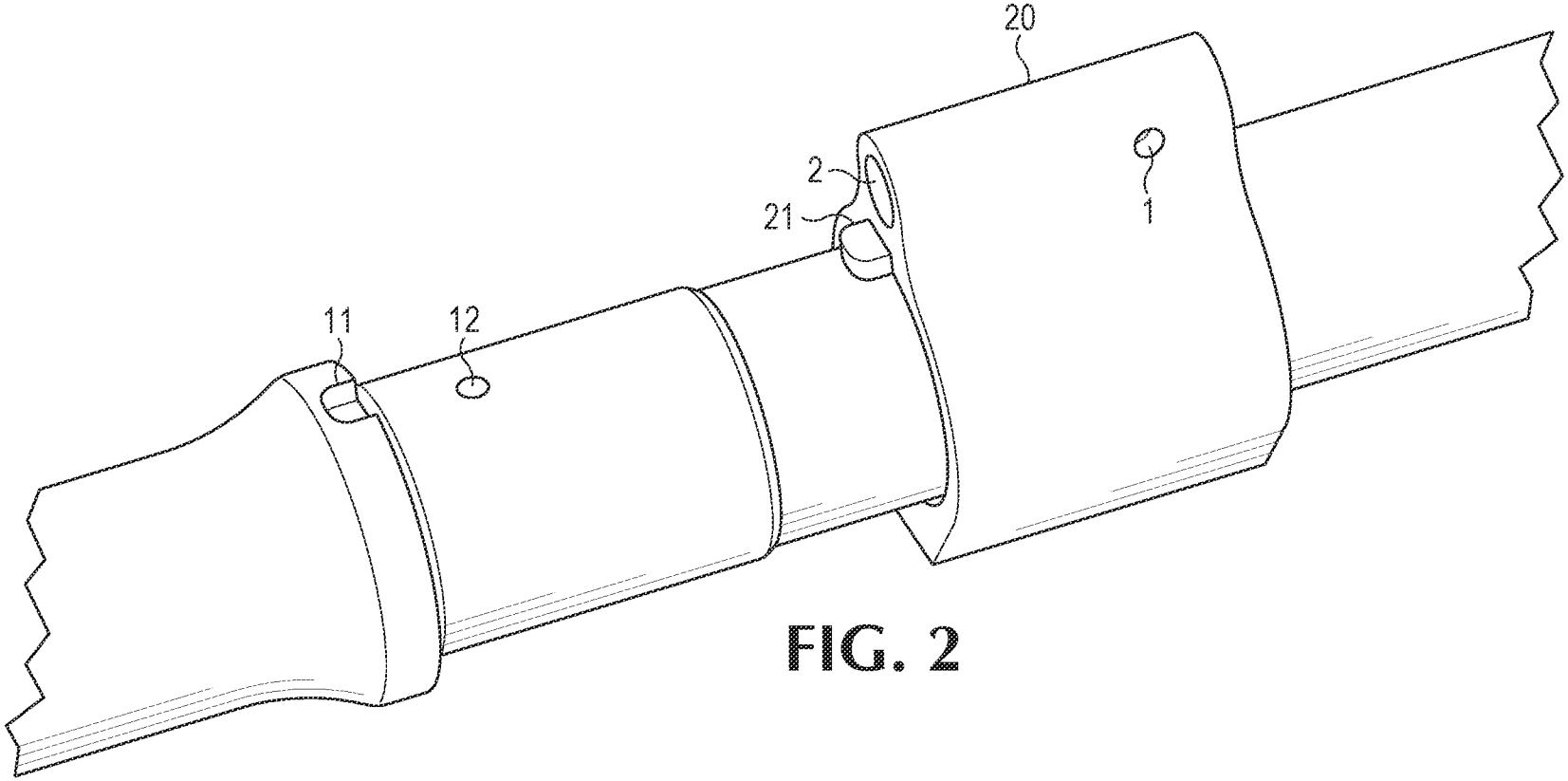
FIG. 2 illustrates a view of the timing system of FIG. 1 in which the gas block has been pulled away from the shoulder, according to various embodiments.
Figure 3:
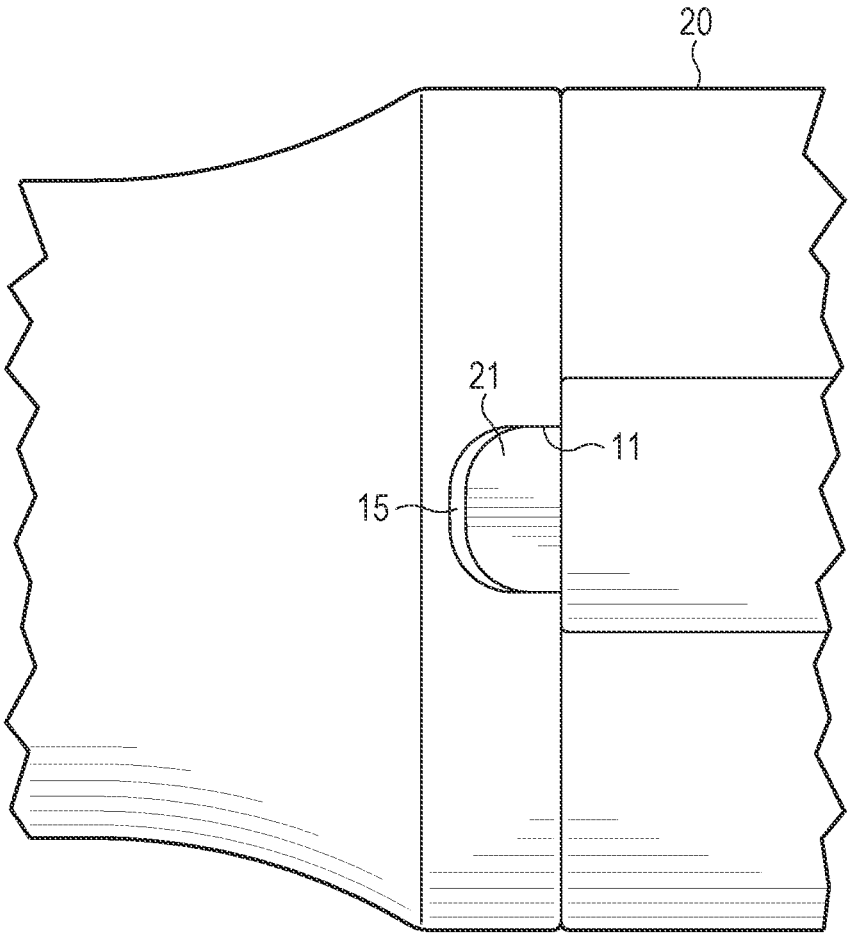
FIG. 3 illustrates a top view of the timing system of FIG. 1, according to various embodiments.

FIG. 1 illustrates a timing system for a firearm gas block, according to various embodiments. FIG. 2 illustrates of view of the timing system of FIG. 1 in which the gas block has been pulled away from the shoulder. Although this particular example is for an AR15, it should be appreciated that any of the features illustrated or described herein may be used in any firearms having gas-operation systems (including direct impingement systems, piston-driven systems, and any other gas operation system now known or later developed). FIG. 3 illustrates a top view of the timing system of FIG. 1.

Referring now to FIG. 2, the timing system includes the timing notch 11 located on the shoulder and the timing boss 21 located on the end of the gas block 20. The timing notch 11 may be formed by selectively machining the barrel or the shoulder, for example, by recessing the planar surface of the shoulder using a milling cutter. In the illustrated example, the timing notch 11 may be formed by recessing the shoulder. The timing boss 21 may be formed by selectively machining the gas block 20.

The timing system including the timing notch 11 and the timing boss 21 is for timing the gas block 20, and may be independent from fasteners used to secure the gas block 20 once timed. Any known fasteners (not shown) may be used in combination with any gas block using the timing system (such as set screws located at the bottom of the gas block 20 (not shown) to pull the bore of the gas block against the barrel). The timing system may also be independent from the illustrated hole 1 on the side of the gas block (this hole 1 is for pinning the end of a gas tube (not shown) into the gas block at the large hole 2 shown in the illustration).

Referring now to FIGS. 1 and 3, when the timing boss 21 is located in the timing notch 11 as shown, the gas block 20 is in the correct rotational orientation to position an ingress port on the interior of the gas block 20 over the gas port 12 (FIG. 2, the gas port 12 located on the barrel) with no misalignment.

Unlike the use of a template and screws, the timing system is independent of the fasteners used (so an operator need not have the expertise to feel the difference between a template and a screw biting into a barrel). The timing notch 11 and the timing boss 21 may be integrally formed as part of the shoulder and the gas block, respectively, hence fastener parts like pins required to time the gas block in some other systems may not be required.

In the illustrated embodiment, the timing boss 21 may be dimensioned so that the tip of the timing boss 21 does not contact the closed end of the timing notch 11 (a small gap 15 is shown between the tip of the timing boss 21 and the closed end of the timing notch 11). In this example only the sides of the timing boss 21 may make contact, as shown in more detail in FIG. 3 (the timing boss 21 may have a width arranged to fit into the timing notch 11 and a height selected to form the gap 15 when the timing boss 21 is in the timing notch 11). The gap 15 may be provided to ensure that the gas block 20 contacts the shoulder (such contact provides alignment in the lengthwise direction). However, in other embodiments, the sides and tip of the timing boss 21 may contact the timing notch 11. For instance, in one embodiment, the shoulder may be cut with long shallow notches to form a wavy surface defining timing indentations around the shoulder. In such an embodiment, the end of the gas block may be cut similarly to form wide timing protrusions to fit in the timing indentations.

In other embodiments, the barrel may not include a shoulder. The barrel can be selectively machined to leave an integrated projection (such as a column, post, or the like) that fixes a position of a gas block in the linear direction and is wide enough to cut a timing notch. In this embodiment, the sides and tip of the timing boss may make contact with the timing notch (that is cut into the projection) to fix the position of the gas block in the linear direction and angular orientation.

In yet further examples, the integrated projection of the barrel may form a timing protrusion (such as a timing boss) and a timing indentation may be cut into the end of the gas block.

The gas block shown in the figures does not include a slit. Some gas blocks may include a slit (say at the bottom of the gas block) to allow the gas block to expand to slide onto the journal. Fasteners may close the slit to clamp the gas block onto a journal of the barrel. Any timing system described herein may be used with this type of gas block, or any other type of gas block available today, or later developed. Any timing system described herein may be used in combination with any adjustable firearm gas block described herein or designed in U.S. Provisional Patent Application 62/861,827 (filed Jun. 14, 2019) and U.S. patent application Ser. No. 16/900,161 (filed Jun. 12, 2020), each of which is incorporated by reference herein.

In one example, a barrel assembly for a firearm is provided. The barrel assembly may include a barrel having a gas port and a shoulder or other projection; a gas block around the barrel and covering the gas port, wherein an end of the gas block faces the shoulder of the barrel or the other projection of the barrel; and a timing system including a timing protrusion and a timing indentation, the timing system to rotationally orient the gas block to position an ingress port of the gas block over the gas port (located on the barrel) when the timing protrusion is positioned in the timing indentation, wherein one of the timing protrusion and the timing indentation is formed at the end of the gas block and the other one of the timing protrusion and the timing indentation is formed at the shoulder of the barrel or the other projection of the barrel.

In one example of this barrel assembly, the timing indentation comprises a single timing notch and the timing protrusion comprises a single timing boss.

In one example of this barrel assembly, the timing protrusion is integrally formed on the end of the gas block.

In one example of this barrel assembly, the timing indentation comprises a cut into a side of the shoulder of the barrel or the other projection of the barrel.

In one example of this barrel assembly, the barrel assembly may further include one or more fasteners to pull the bore of the gas block against a journal of the barrel, wherein the timing system is separate from the fasteners. In one example, the one or more fasteners are installed on a first side of the barrel, and wherein the timing system is located on a second opposite side of the barrel.

In one example of this barrel assembly, the gas block defines a slit, and wherein the one or more fasteners close the slit to clamp the gas block onto a journal of the barrel.

In one example of this barrel assembly, the shoulder of the barrel or the other projection of the barrel includes a surface that makes contact with a surface of the end of the gas block when the timing protrusion is positioned in the timing indentation, wherein the timing indentation comprises a hole formed in one of the surfaces.

In one example of this barrel assembly, the barrel assembly includes a gap located between a tip of the timing protrusion and an end of the timing indentation when the surfaces are in contact.

In one example, a firearm is provided. The firearm may include a barrel having a gas port and a shoulder or other projection; a gas block around the barrel and covering the gas port, wherein an end of the gas block faces the shoulder of the barrel or the other projection of the barrel; and a timing system including a timing protrusion and a timing indentation, the timing system to rotationally orient the gas block to position an ingress port of the gas block over the gas port (located on the gas barrel) when the timing protrusion is positioned in the timing indentation, wherein one of the timing protrusion and the timing indentation is formed at the end of the gas block and the other one of the timing protrusion and the timing indentation is formed at the shoulder of the barrel or the other projection of the barrel. In one example, the firearm comprises an AR-15.

In one example of this firearm, the timing indentation comprises a single timing notch and the timing protrusion comprises a single timing boss.

In one example of this firearm, the timing protrusion is integrally formed on the end of the gas block.

In one example of this firearm, the timing indentation comprises a cut into a side of the shoulder of the barrel or the other projection of the barrel.

In one example of this firearm, the firearm may further include one or more fasteners to pull an underside of the gas block against a journal of the barrel, wherein the timing system is separate from the fasteners. In one example, the one or more fasteners are installed on a first side of the barrel, and wherein the timing system is located on a second opposite side of the barrel.

In one example of this firearm, the gas block defines a slit, and wherein the one or more fasteners close the slit to clamp the gas block onto a journal of the barrel.

In one example of this firearm, the shoulder of the barrel or the other projection of the barrel includes a surface that makes contact with a surface of the end of the gas block when the timing protrusion is positioned in the timing indentation, wherein the timing indentation comprises a hole formed in one of the surfaces. In one example, the firearm further includes a gap located between a tip of the timing protrusion and an end of the timing indentation when the surfaces are in contact. In one example, the surfaces comprise planar surfaces.

Adjustable Firearm Gas Block

A user may desire to restrict the flow of gas from a gas port 12 (FIG. 2) into the gas tube, e.g., a gas tube installed into the opening 2 (FIG. 2) at the end of the gas block 20 (FIG. 2). The performance advantages of restricting this gas flow are known, such as to compensate for the user of a suppressor and/or to modify the performance of the firearm. As is known, this gas flow can be reduced down to the minimal level needed to automatically cycle the firearm or reduced down even further in which case the user will manually cycle the firearm.

A known adjustable firearm gas block is described in U.S. Pat. No. 9,410,756. In the known adjustable firearm gas block, an adjustment screw is tightened down a user-selectable amount to reduce the gas flow as desired. To keep the adjustment screw from unintentionally rotating again after selecting a position, an axial groove is provided in the threaded section of the adjustment screw. A detent plunger may engage this axial groove in various rotational positions of the axial screw. This arrangement requires a number of individual components—a detent slot for the leaf spring, a fastener to hold down one end of the leaf spring, a detent bore for holding the detect plunger between the adjustment screw and the other end of the leaf spring.

Various known adjustable firearm gas blocks are cost prohibitive to manufacture and/or suffer other drawbacks. An improved gas block may reduce manufacturing costs and/or provide other benefits compared to known adjustable firearm gas blocks.

Figure 4A:
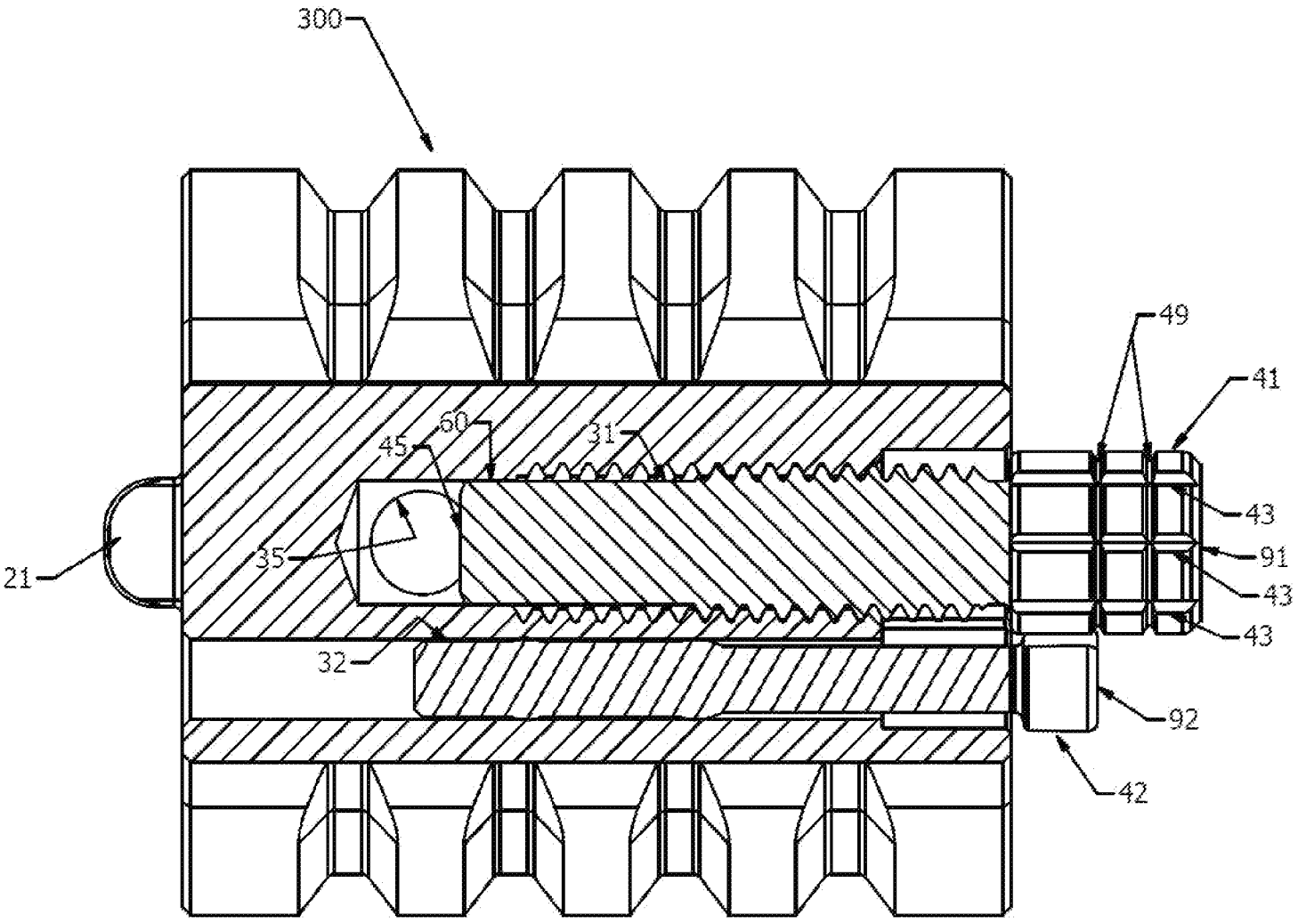
FIGS. 4A and 4B illustrate sectional top views of one embodiment of an adjustable firearm gas block in which the adjustable firearm gas block is arranged for use with the firearm barrel assembly described with respect to FIGS. 1-3.
Figure 4B:
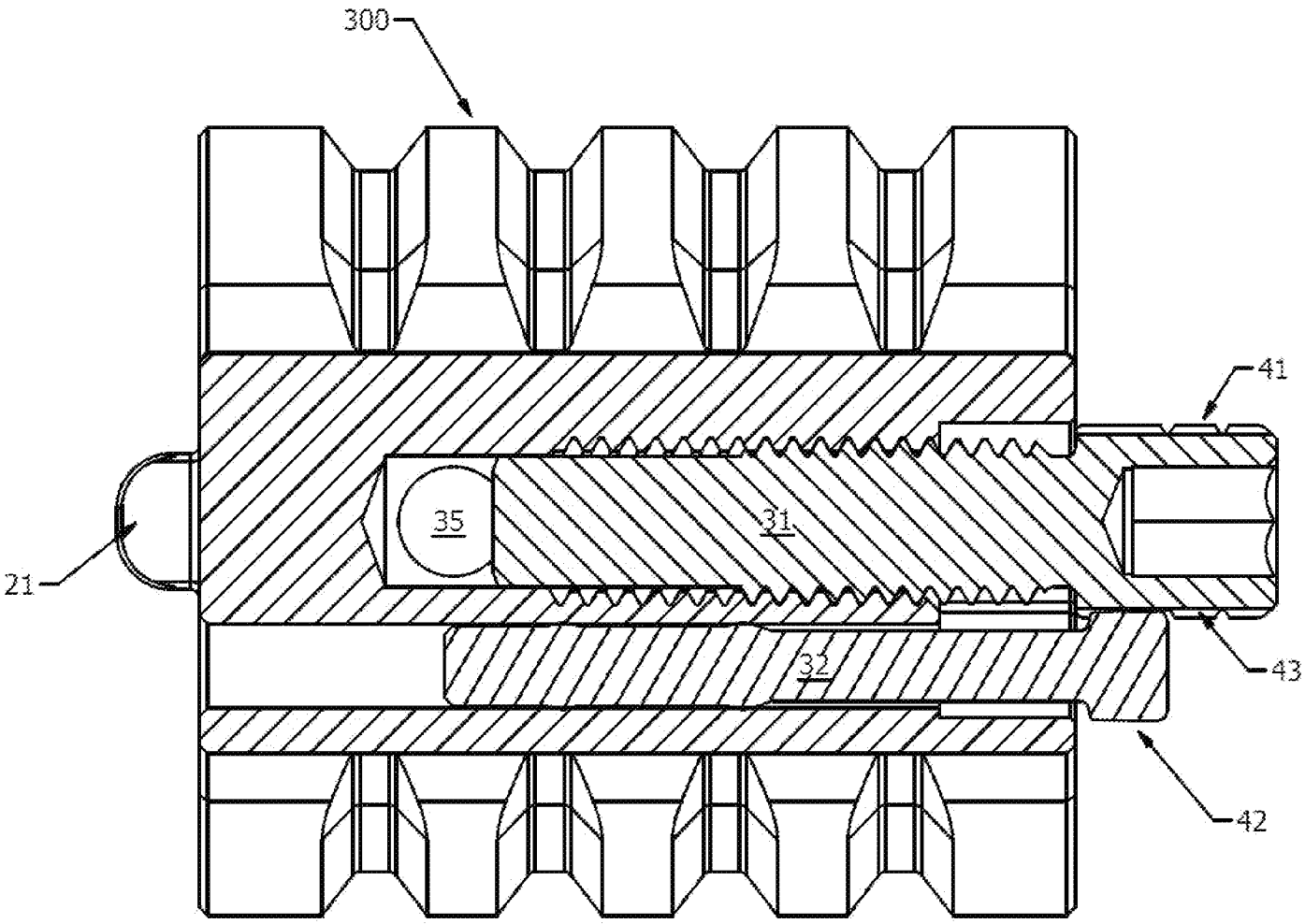

FIG. 4A illustrates a sectional top view of one embodiment of an adjustable firearm gas block 300 in which a section of the gas block above a centerline of a gas metering screw 31 has been removed. FIG. 4B illustrates another sectional top view in which a head 41 of the gas metering screw 31 and a head 42 of a spring pin 32 above a centerline of the heads 41 and 42 are also similarly sectioned. Since this embodiment of an adjustable firearm gas block is arranged for use with the barrel assembly described with respect to FIGS. 1-3, the timing boss 21 (FIG. 2) is present in this embodiment. It should be appreciated that any adjustable firearm gas block features described herein can be used in any known barrel assembly whether or not that barrel assembly includes any of timing system features described with respect to FIGS. 1-3.

The adjustable firearm gas block 300 includes a gas metering screw 31 having a head 41 drivable to position an end 45 of the gas metering screw 31 into a channel over the ingress port 35, which impedes the flow of gas from the gas port 12 (FIG. 2) to a gas tube inserted in the opening 2 (FIG. 2). A spring pin 32 has a head 42 that makes contact with the head 41 of the gas metering screw 31.

Figure 5:
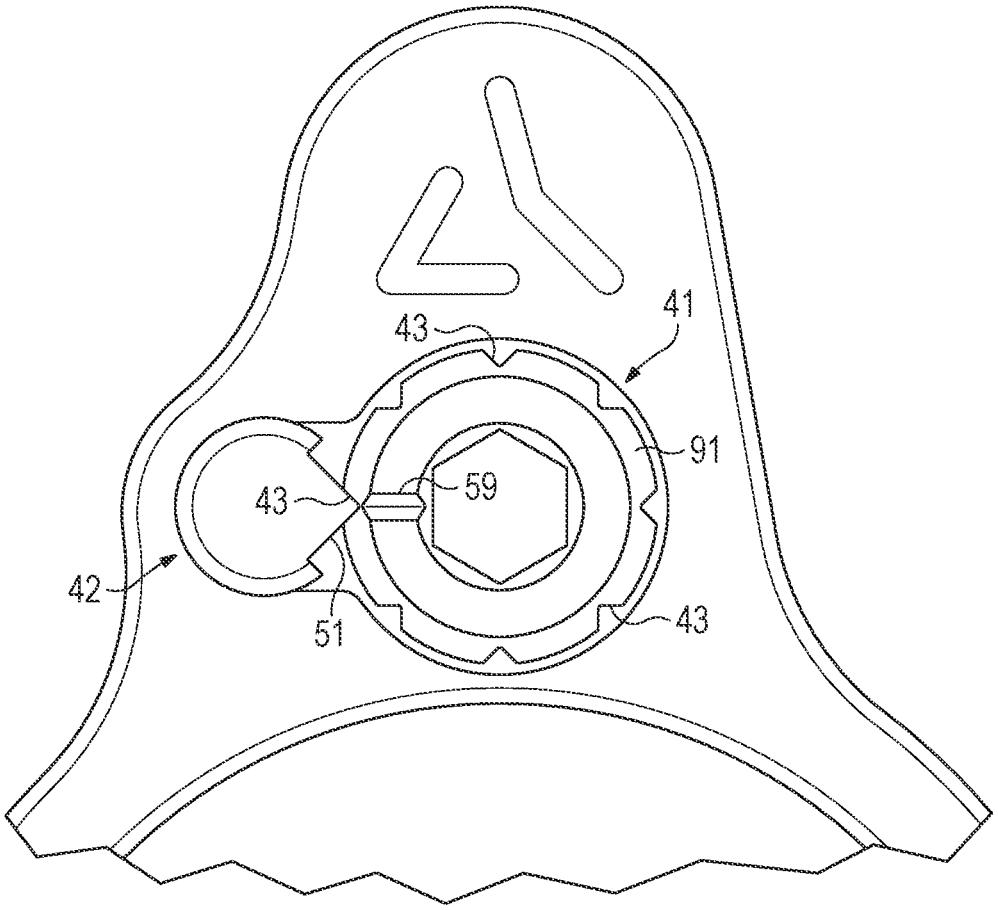
FIG. 5 illustrates a front view of the adjustable firearm gas block of FIGS. 4A and 4B.

The head 41 has a plurality of indentations 43 and areas between the indentations 43. When the head 42 makes contact with the area between the indentations 43, the spring pin 32 is not relaxed. When the head 42 is aligned with one of the indentations 43, the spring pin 32 may relax (e.g., completely relax in some embodiments). FIG. 5 illustrates a front view in which a pointed tip 51 of the spring pin 32 is shown in one of the indentations 43.

In this example, the plurality of indentations 43 are formed by removing material from a cylindrical sidewall of the head 41. In other examples, a sidewall of a head of a gas metering screw may have bumps formed therein. In such an example, a sidewall of the head of a spring pin may have a gap to mate with the bumps. No force (or a small force) may be applied to the head of the gas metering screw (by the head of the spring pin) when an individual one of the bumps is positioned in the gap. A larger force may be applied to the head of the gas metering screw (by the head of the spring pin) when there is no alignment of any of the bumps with the gap. Although the sidewall of the head 41 is cylindrical in this embodiment, in other embodiments the sidewall may have any number of flats (such as hexagonal column shape in one example). In examples in which the sidewall has flats, the vertex (where the flats meet) may be the "bumps" that interface with an indentation on the spring head.

In one example in which the spring pin 32 (FIGS. 4A and 4B) may be completely relaxed when the pointed tip 51 of the head 42 is aligned with the one of the indentations 43, the indentations 43 may be deeper than a height of the pointed tip 51. This may allow the pointed tip 51 to be located in a void of one of the indentations 43 without any contact of the top of the pointed tip 51 and the bottom of the void. This may allow the spring pin 32 to completely relax, which may increase longevity. This feature may allow a very slight rotational movement of the gas metering screw 31 when aligned, which gives a user feedback that alignment has been achieved (and in the middle of this slight rotational range there may be zero contact between the heads 41 and 42). In such an example, the slope of the pointed tip 51 may be linear and the slope of the indentations 43 may be non-linear (e.g., curved), although such a feature may not be required to provide the user feedback (the slopes can be the same if the void is larger than the pointed tip 51).

Referring again to FIGS. 4A and 4B, the system 300 may be arranged to fully obstruct the channel over the ingress port 35 with the end 45 of the gas metering screw 31. In this state, an end 91 of the head 41 may align with an alignment feature (such as an end 92 of the head 42 of the spring pin 32) to indicate to the user that the channel over the ingress port 35 is fully obstructed. Also, in various embodiments, the head 41 may have circumferential markings 49 (e.g., indentations or bumps in other examples). In the case of more than one indentation, an innermost one of the circumferential markings 49 (e.g., indentations or bumps in other examples) may align with the alignment feature (e.g., the end 92 of the head 42) in the fully open position (as illustrated). Another one of the circumferential markings 49 (e.g., the indentations or bumps in other examples) may align with the alignment feature (e.g., the end 92 of the head 42) in a state between fully open and fully closed, e.g., half open in the present example. In this example, the end 92 of the head 42 of the spring pin 32 is a planar face and the end 91 of the head 41 of the gas metering screw 31 is a planar face, however, this is not required (in other examples, an end of the spring pin 32 may be a curved face or some other end and/or the end of the gas metering screw 31 may be a curved face or some other end).

Also, in this example, the adjustable firearm gas block includes the spring pin 32. In other examples, an adjustable firearm gas block may include the gas metering screw 31 and some other mechanism (e.g., now known of later developed) to preserve the rotational position of the gas metering screw 31. This mechanism may include a columnar projection extending from a front face of the adjustable firearm gas block 300 (similar to how spring pin 32 extends from the front face), or may be any other mechanism behind the front face of the adjustable firearm gas block 300 (e.g., at least partially inside the adjustable firearm gas block 300). In various embodiments, the alignment feature may be an end of the columnar projection or the front face of the adjustable firearm gas block.

Referring again to FIG. 5, the end 91 of the head 41 may include a reference marking 59 such as an indentation (or bump in some other example) alignable with a predefined reference to aid a user in tracking the position of the gas metering screw 31. In this example, the predefined reference is the pointed tip 51. However, in other examples, the predefined reference can be some other projection, indentation, or marking on a side or end of the head 42 of the spring pin 32. A user may count "clicks" from alignment of this reference marking 59 with the predefined reference for fine adjustment tracking (together with the course adjustment tracking described with reference to FIGS. 4A and 4B) as the user tries different gas restriction settings.

In some examples, optionally, a position of the gas metering screw 31 may be timed in the threaded hole so that alignment of the reference marking 59 with the predefined reference coincides with optimal alignment of the circumferential marking 49 with the alignment feature. In this way, a user can judge whether one of the circumferential markings 49 is exactly aligned with the alignment feature (e.g., in the illustrated example the end 92 of the head 42 of the spring pin 32). However, timing the position of the gas metering screw 31 is not required in various embodiments.

According to variously described examples above, the predefined reference is part of the head 42 of the spring pin 32 (e.g., part of the sidewall of the spring pin 32). In other examples, the predefined reference may be a mark on the end 92 of the head 42 of the spring pin 32, or a mark on the face of the front end of the adjustable firearm gas block 300 in embodiments without a columnar projection such as the spring pin 32.

Referring to FIGS. 4A and 4B and 5 in combination, it may be possible in some examples for a user to grip the head 41 (aided by the indentations 43 the indentations of the circumferential markings 49 in some examples) for tool-less adjustment of the gas metering screw 31. In any event, in the illustrated embodiment a user may use a hex wrench in the hex socket illustrated on the end 91 of the head 41 in FIG. 5. In other examples, any other type of drive mechanism can be used (e.g., some other type of socket and or wrench). In example in which the head 41 has any number of flats (such as a hexagon columnar shape as one example), the head 41 may be sized to mate with a wrench to drive the head 41 (the wrench may receive the hexagonal columnar shaped head 41).

Referring again to FIGS. 4A and 4B, a seal 60 may be formed by a smooth section of the gas metering screw 31 and a smooth hole at the bottom of the threaded hole. The seal 60 is maintained in any selected position of the gas metering screw 31. This seal 60 may prevent gas and/or debris carried by the gas from reaching the threading of the gas metering screw 31. This may keep the threading clean so that the gas metering screw 31 does not seize up after prolonged use. In this example, the smooth hole at the bottom of the threaded hole has the minor diameter of the threads; however, in other examples the diameter of the smooth hole may be smaller than the minor diameter of the threads. This view also illustrates the interference fit of the mounting section of the spring pin 32.

Figure 6A:
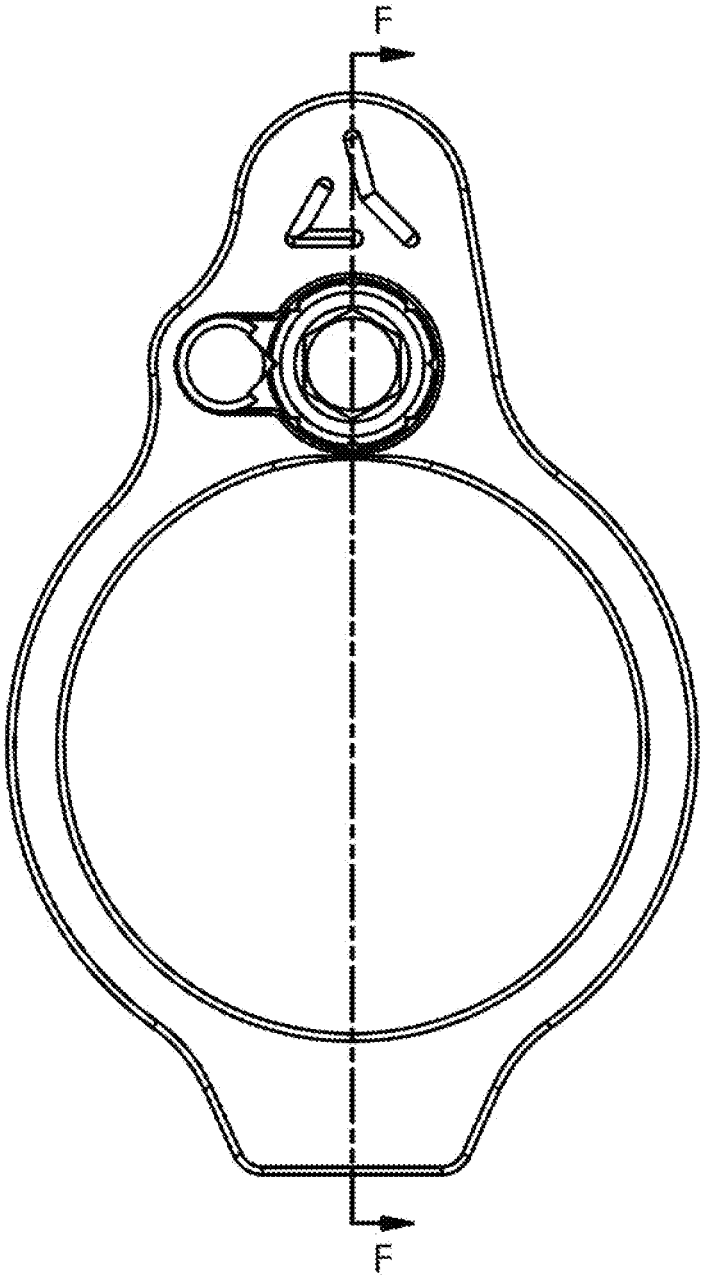
FIG. 6A illustrates a front end view of the adjustable firearm gas block of FIGS. 1-4B.
Figure 6B:
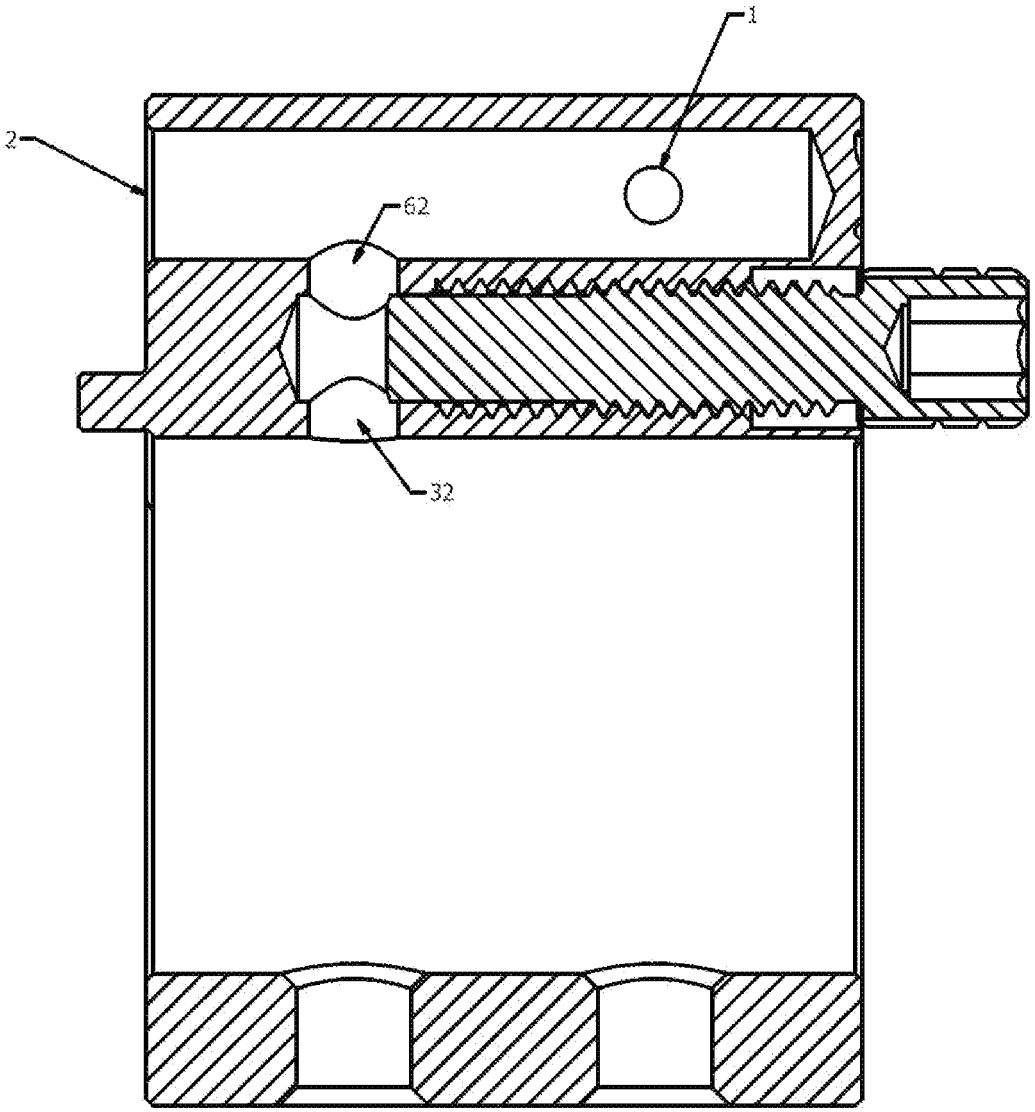
FIG. 6B illustrates a cross-sectional view taken along section line F of FIG. 6A.

FIG. 6A illustrates a front end view of the adjustable firearm gas block of FIGS. 1-4B, and FIG. 6B illustrates a cross-sectional view taken along section line F of FIG. 6A. Referring to FIG. 6B, when the ingress port 35 is not completely covered, gas travels to the opening 62 where it may enter an opening of a gas tube (not shown) installed in the large hole 2. The hole 1 (FIG. 1) for pinning the gas tube is also shown in this view.

Figure 7A:
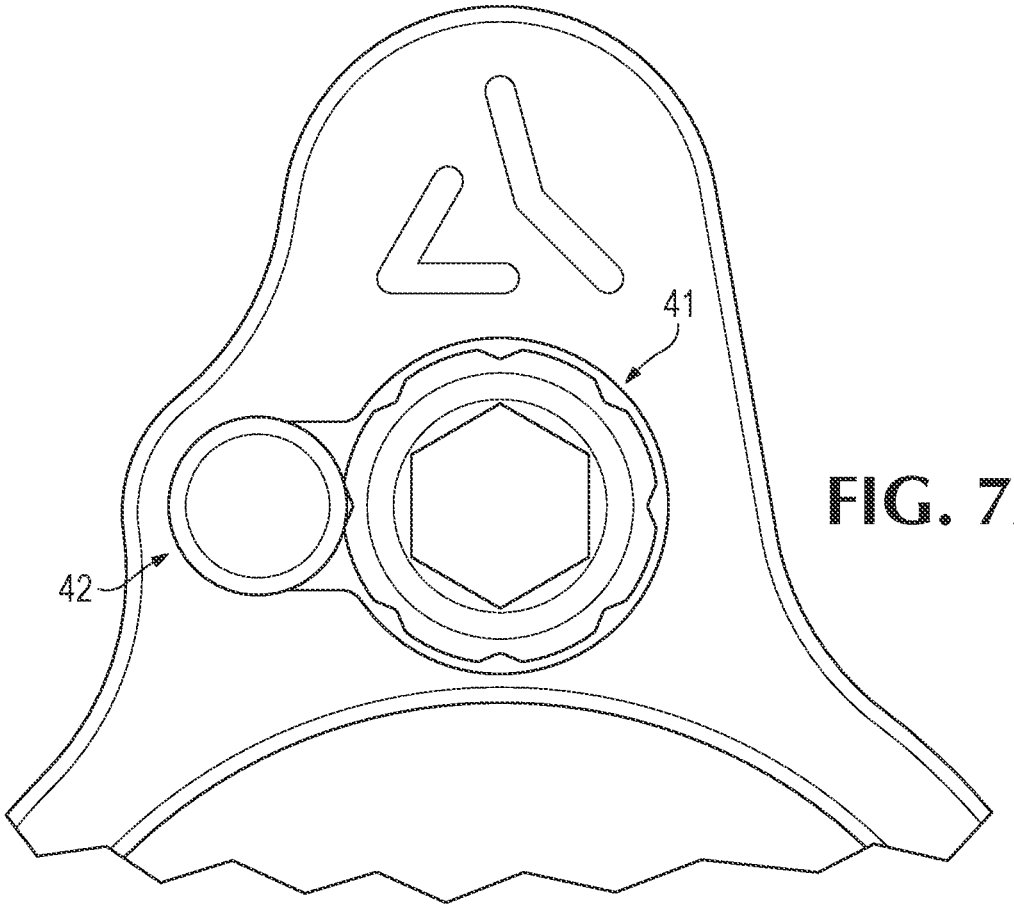
FIG. 7A is a front view of another embodiment of an adjustable firearm gas block.
Figure 7B:
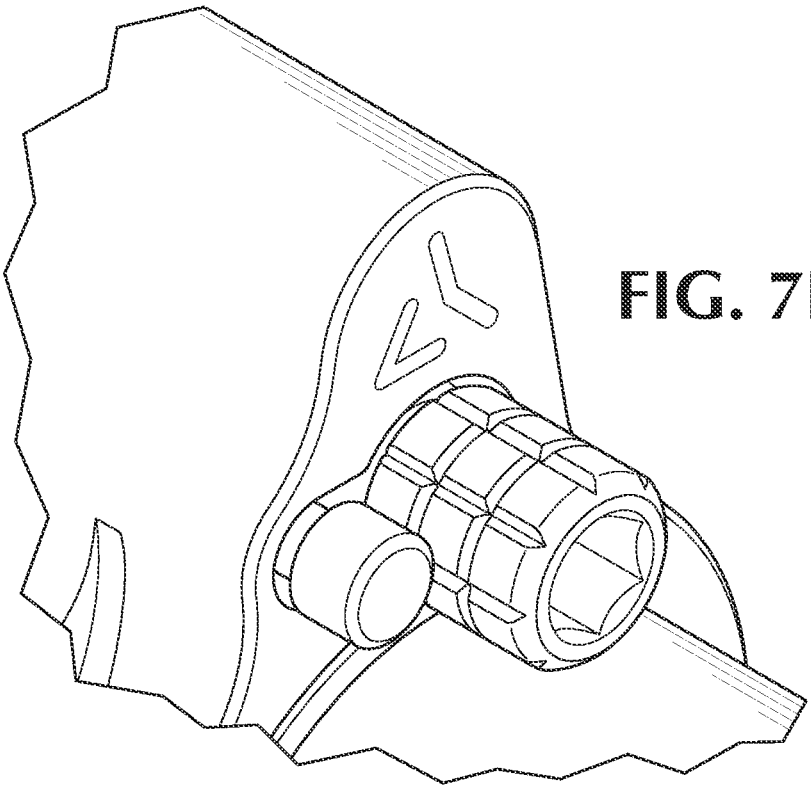
FIG. 7B is a isometric view showing visual indicators on a sidewall of a head of the gas block screw of the adjustable firearm gas block shown in FIG. 6B.

FIGS. 7A and 7B illustrate a front view and an isometric view, respectively, of another embodiment similar in any respect to the adjustable firearm gas block described with reference to FIGS. 4A-6B. In this embodiment, the head 41 of the spring pin 32 has no cut away (e.g., no pointed tip). The slope of the plurality of indentations on the head 41 of the gas metering screw 31 is shallower than the slope of the indentations in the embodiment described with reference to FIGS. 4A-6B (also each indentation is wider). This embodiment still provides one indentation every 45 degrees, but it may be possible and practical to provide more indentations (if desired) using the approach described with respect to the embodiment described with respect to FIGS. 4A-6B.

It may be possible to keep the spring pin in a fully resting state when aligned with the indentations in either embodiment; however, this is not required. In other embodiments, the spring pin may apply less force to the gas metering screw in some rotational positions than other rotational positions. In either case, the adjustable firearm gas block still may give a user a clicking feedback associated with finite rotational positions between intermediary positions.

Any adjustable firearm gas block described herein may be used in the barrel assembly described with reference to FIGS. 1-3, or any known barrel assembly or later developed barrel assembly. Referring to FIGS. 4A-6B, the adjustable firearm gas block may be manufactured without the timing boss for use with known barrel assemblies, e.g., mil spec barrel assemblies. Likewise, the barrel assembly described with reference to FIGS. 1-3 may be manufactured with the adjustable firearm gas block features described herein, any other adjustable firearm gas block features known or later developed, or any other gas block features (such as on a standard non-adjustable firearm gas block).

Although various adjustable firearm gas blocks described with reference to FIGS. 4A-7B utilize a self-retaining spring pin, this is not required. Other embodiments may utilize some other structure with a section to make contact with the head of an adjustable firearm gas block. These pieces may protrude from the adjustable firearm gas block so that a position may be visually indicated to a user (in addition to any audible "clicking" indication provided by the structure moving into and out of indentations on the head of the gas metering screw). Other structures, self-retaining or otherwise, may be used to selectively release a force on a head of the gas metering screw at different rotational positions of the gas metering screw (the force is applied on the gas metering screw at intermediary rotational positions between the rotational positions).

Although various embodiments described with respect to FIGS. 4A-7 are for an AR15, it should be appreciated that any of the adjustable gas block features illustrated or described herein may be used in any firearms having gas-operation systems (including direct impingement systems (which may use a gas tube similar to the gas tube described herein), piston-driven systems, and any other gas operation system now known or later developed).

Timing, Fastening, and Sealing Features for Firearm Gas Blocks

As explained earlier herein, a shoulder may be formed behind a location for a gas block by selectively removing material when the barrel is machined, and this shoulder fixes the position of the gas block in the lengthwise position. However, known shoulders do not prevent mis-timing the gas block (say, a wrong angular orientation in which gas flow is significantly impeded).

Figure 8:
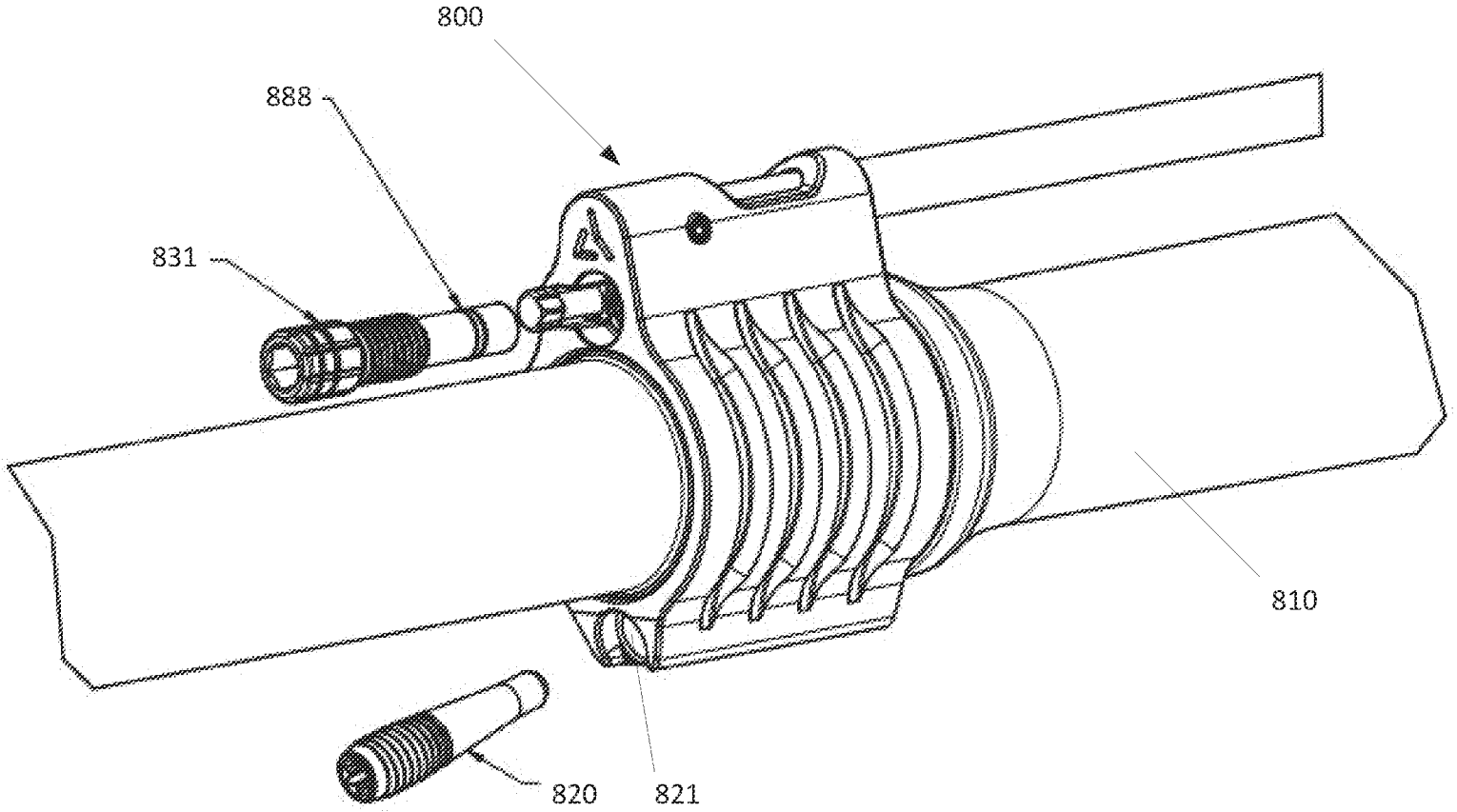
FIG. 8 illustrates an isometric view of another adjustable firearm gas block, according to various embodiments.
Figure 9A:
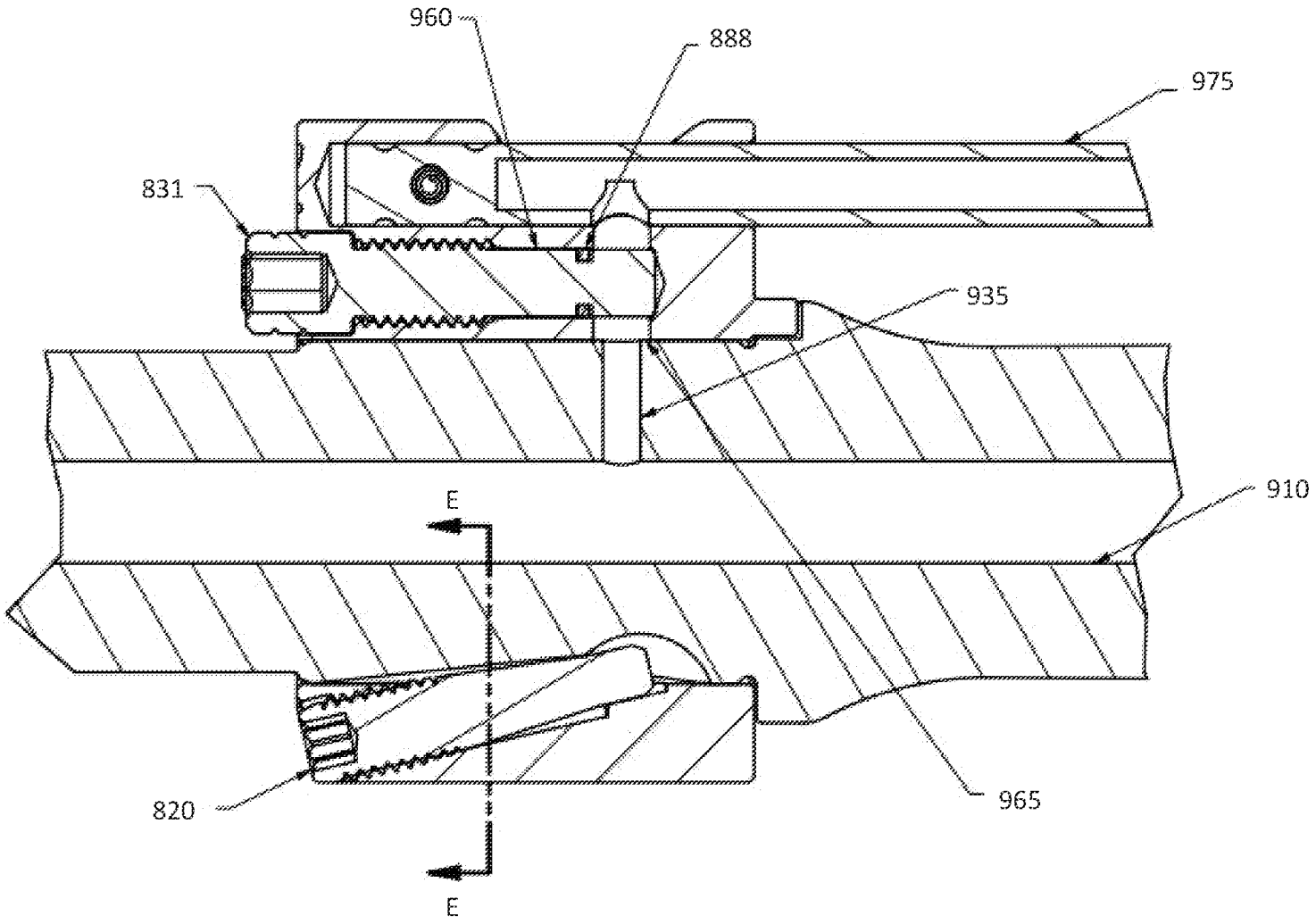
FIG. 9A illustrates a cross-sectional view of the adjustable firearm gas block of FIG. 8, according to various embodiments.
Figure 9C:
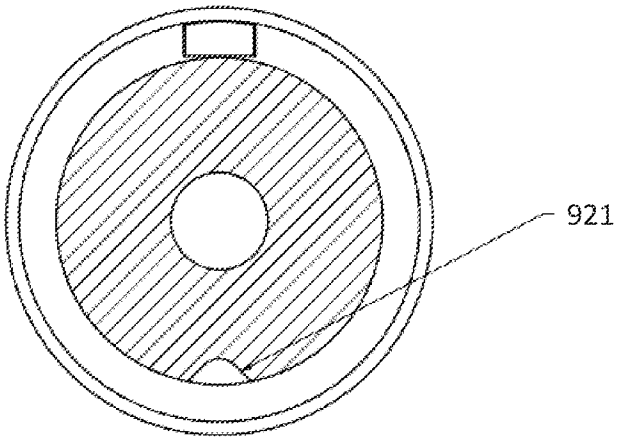
FIG. 9C illustrates a cross-section view of the barrel illustrated in FIG. 9A at a taper interface.
Figure 9B:
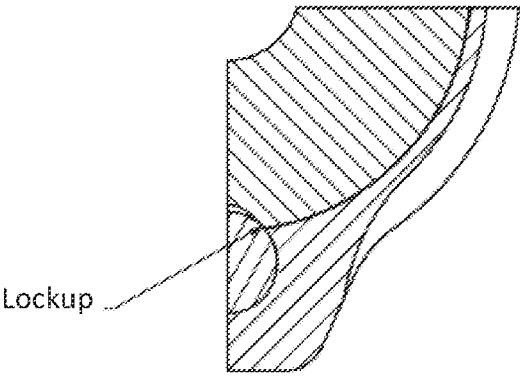
FIG. 9B illustrates a partial cross-sectional view taken along section line E of FIG. 9A.
Figure 9D:
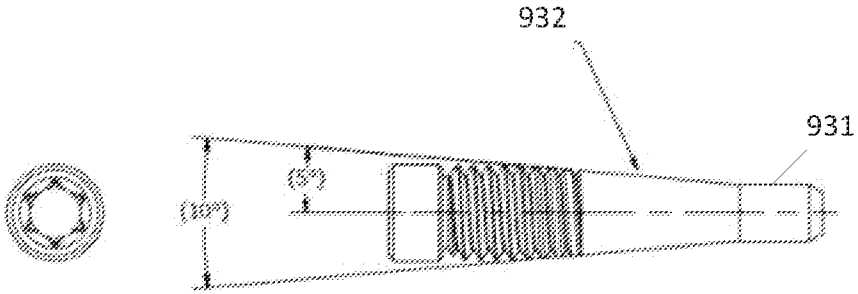
FIG. 9D illustrates the tapered fastener of the adjustable firearm gas block of FIG. 8.

FIG. 8 illustrates an isometric view of another adjustable firearm gas block 800, according to various embodiments. FIG. 9A illustrates a cross-sectional view of the adjustable firearm gas block 800 of FIG. 8, according to various embodiments. FIG. 9B illustrates a partial cross-sectional view taken along section line E of FIG. 9A. FIG. 9C illustrates a cross-section view of the barrel 810 illustrated in FIG. 9A at a groove 921 on the barrel. FIG. 9D illustrates the tapered fastener 820 of the adjustable firearm gas block 800 of FIG. 8.

The adjustable firearm gas block 800 may include a timing system including a tapered fastener opening 821 and a tapered fastener 820 insertable in the tapered fastener opening 821. This timing system rotationally orients the adjustable gas block 800 to position an ingress port of the gas block 800 over a gas port of the barrel (e.g., the gas port to supply gas from the barrel).

Referring to FIG. 9C, which shows a cross section of the barrel 810 at the groove 921 on the barrel (with the tapered fastener 820 removed for clarity), the barrel 810 may define a groove 921, which may be similar in any respects to any barrel-defined groove described in the '399 publication. In this example, the groove 921 is a "V" slot. In other examples, a different slot may be provided, such as a rounded slot.

The tapered fastener 820 may be similar in any respect to any tapered fastener described in U.S. Patent Application Publication 2021/0231399, which is incorporated by reference herein. As illustrated in FIG. 9D, the tapered fastener 820 includes four sections: a threaded section, a tapered section 932, and a straight section proximate to each end (including small end 931). As the tapered fastener 820 starts to engage the groove 921 (FIG. 9C) the straight sections may prevent the tapered fastener 820 from being urged away from the barrel 810 (FIG. 8). Specifically, the adjustable gas block 800 is arranged to form a hole of a corresponding diameter that the small end of the tapered faster 820 fits into and a counter bore with a corresponding diameter that the large end of the tapered faster 820 fits into (this can be seen in FIG. 9A). The tapered fastener 820 may be held into place on both sides of the taper lock interface 932 by these straight sections to keep either end of the tapered fastener 820 from moving away from the barrel 810.

In other embodiments, a tapered fastener may not require the straight sections proximate to each end. A tapered fastener may include a single continuous taper with a first region having a taper lock interface to contact a taper interface of a barrel and a second region to contact a gas block. In other embodiments, a tapered fastener may have two distinct sections—a tapered first section to contact a taper interface of a barrel and a second non-tapered (or differently tapered) section to contact a gas block.

Referring again to FIG. 9A, when the tapered fastener 820 is tightened (e.g., using a wrench tool in this example), the taper lock interface 932 (FIG. 9D) contacts a corresponding taper interface on the barrel 810. In this example, the tapered fastener 820 includes threading to interface with an internal thread in the adjustable gas block 800; however, this is not required. In other examples, a tapered fastener may not include threads—it could be driven into the hole in the adjustable gas block device 800 to lockup with the taper lock interface provided on the barrel 810.

The lockup of the interface 932 with the taper interface on the barrel is illustrated in FIG. 9B. This lockup rotationally times the adjustable gas block 800 in the correct rotational position around the barrel 810, which aligns the ingress port 965 of the adjustable gas block 800 to the gas port 935 of the barrel 810 without the use of a jig. The lockup also sealingly couples the adjustable gas block 800 to the barrel 810 by pulling the bore of the adjustable gas block 800 against a journal of the barrel 810.

In this embodiment, the gas block 800 is adjustable—it includes a gas metering screw 831 (or some other rotationally actuated gas metering shaft), which may be similar in any respect to the gas metering screw 31 (FIG. 4A). However, the timing system illustrated in FIG. 8 can be used in any gas block (whether adjustable or not). In one embodiment, the timing system illustrated in FIG. 8 may be used with a gas block similar in any respect to the gas block 20 illustrated in FIG. 1.

Also, since the tapered fastener 820 serves two functions (e.g., timing and pulling the bore of a gas block against a journal of a barrel), the tapered fastener 820 may be used in gas blocks that may already include some other timing system (such as the timing system described with respect to FIG. 1). Unlike some known gas block fasteners that may require thread locking compound to lock threading together, the tapered fastener 820 may be self-locking. The seal formed by this self-locking may not fail over as with other gas block fasteners that may require application of a thread locking compound to threading (this thread locking compound may fail over time due to the effects of barrel heating generated by operation of the firearm). A gas block using the tapered fastener 820 to pull the bore of a gas block against a journal of a barrel may transfer more gas from the barrel into the gas tube 975 than other gas blocks using other fasteners (which may leak gas initially, particularly due to complexity of installation, and over time due to the use of a thread locking compound).

In various embodiments, the bore of a gas block (to receive a rotationally drivable gas metering screw) may be arranged along an axis that is aligned with an axis of the bore of the barrel (e.g., parallel to or where the axes form an acute angle, i.e. where the axes are not perpendicular). The gas metering screw may include threading, however, it may be possible and practical to utilize other gas metering screws with any rotational interlock mechanism.

Referring again to FIG. 9A, in this embodiment, a bore to receive the gas metering screw 831 may include a smooth section to form a seal with a non-threaded length of the gas metering screw 831. This smooth section may be similar to any smooth section described herein, such as the smooth section described with respect to FIGS. 4A to 4B. This smooth section may form a seal with the non-threaded length of the gas metering screw in any selectable position between maximum gas flow and minimum gas flow. As explained previously, this seal may prevent gas and/or debris carried by the gas from reaching the threading of the gas metering screw 831. This may keep the threading clean so that the gas metering screw 831 does not seize up after prolonged use.

In the embodiment illustrated in FIG. 9A, the gas metering screw 831 may also include a groove and one or more one or ring(s) in the groove to form the seal. Laminar gas sealing ring(s) 888 (e.g., metallic spiral retaining ring made from coiled flat wire) may be provided on the gas metering screw 831 to form a seal with the smooth section of the bore 960 in any selected position of the gas metering screw 831. As explained previously, this seal may provide reliable operation of the gas metering screw 831. In this example, the bore 960 below the thread hole has the minor diameter of the threads; however, in other examples the diameter of the bore 960 may be smaller than the minor diameter of the threads.

In various embodiments, any piston seals/rings (e.g., used for fluid sealing), now known or later developed, may be used in an adjustable firearm gas block similar to the interfacing between the laminar gas sealing ring(s) 888 and the bore 960. For example, metallic split rings may be attached to the gas metering screw to interface with a groove in the gas metering screw to form a seal with the bore. It may be possible to use any seals/rings now know or later developed, for example a polymer seal configured to withstand the high temperatures of the gas expelled from the barrel.

Figure 10:
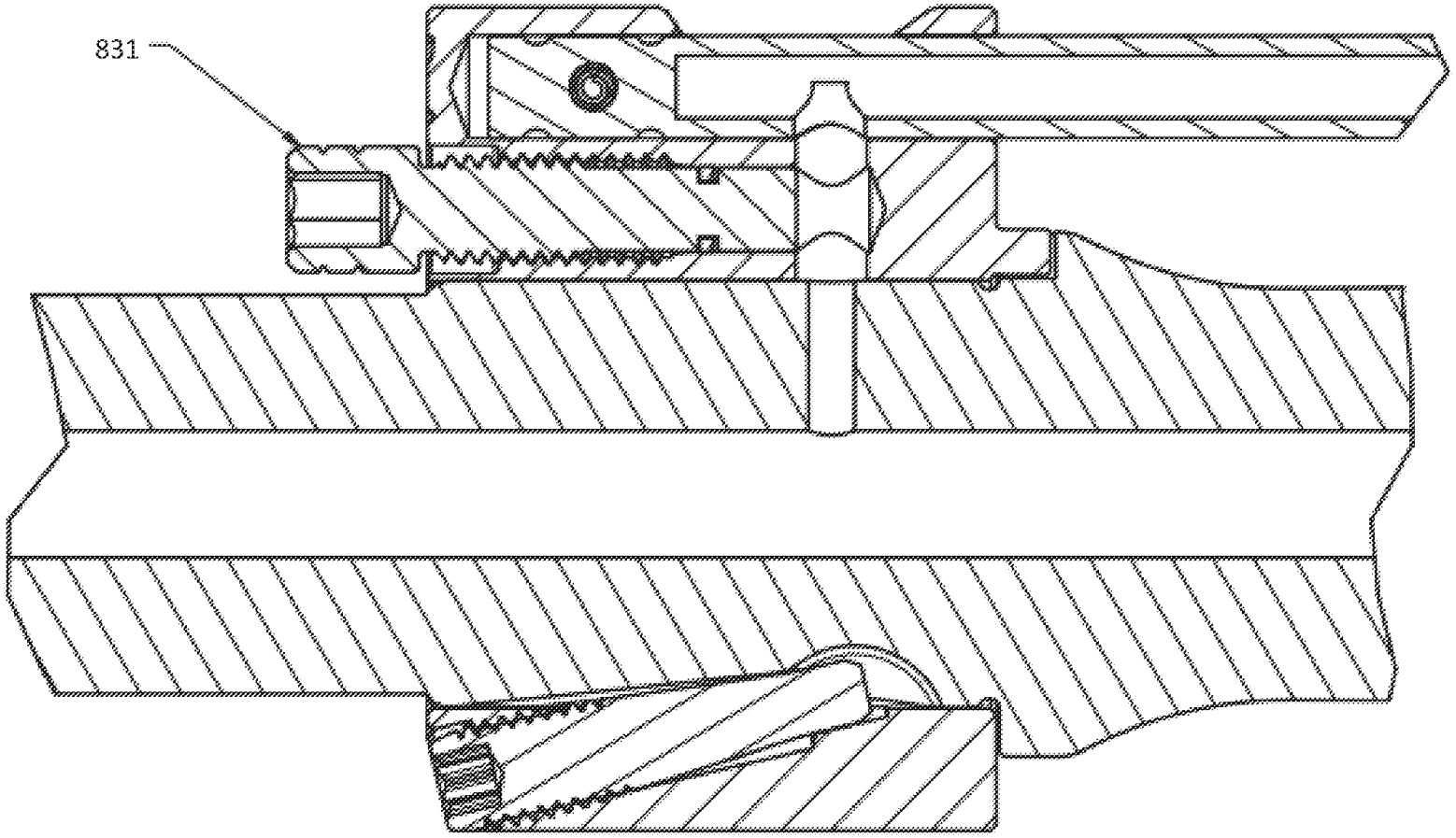
FIG. 10 illustrates another cross-sectional view of the adjustable firearm gas block of FIG. 8 in the fully open state.

FIG. 8 illustrates the adjustable firearm gas block 800 in the fully closed state. FIG. 10 illustrates another cross-sectional view of the adjustable firearm gas block 800 in the fully open state, similar to FIG. 6B.

Having described and illustrated various examples herein, it should be apparent that other examples may be modified in arrangement and detail. We claim all modifications and variations coming within the spirit and scope of the following claims.

The invention claimed is:

1. A barrel assembly for a firearm, the barrel assembly comprising:

a barrel having a gas port and a taper interface, wherein the taper interface includes one or more sloped surfaces defined by part of an exterior of the barrel;

a gas block around the barrel; and the gas block including a timing system including an opening and a tapered fastener insertable in the opening, the timing system configured to rotationally orient the gas block to position an ingress port of the gas block over the gas port, wherein the tapered fastener includes:

a length including a first tapered region arranged to lockup with the one or more sloped surfaces of the taper interface of the barrel, wherein the tapered fastener is configured to move along the taper interface and bias against the one or more sloped surfaces and the gas block to create the lockup; and the length further including a second region to interface with the gas block; and a drive mechanism for rotationally driving the tapered fastener into the opening.

2. The barrel assembly of claim 1, wherein the length includes threading to engage with threading defined by a sidewall of the opening.

3. The barrel assembly of claim 1, wherein the second region is tapered.

4. The barrel assembly of claim 3, wherein the length that includes the first and second regions comprises a continuous taper.

5. The barrel assembly of claim 1, wherein the gas block comprises an adjustable gas block include a rotationally actuated gas metering shaft.

6. A gas block assembly, comprising:

a gas block including a gas port to receive gas provided by a gas port of a barrel;

a tapered fastener including:

a length further including a tapered section configured to lockup with a taper interface defined by the barrel, wherein the taper interface includes one or more sloped surfaces defined by part of an exterior of the barrel, and wherein the tapered fastener is configured to move along the taper interface and bias against the one or more sloped surfaces and the gas block to create the lockup; and a drive mechanism for rotationally driving the tapered fastener into an opening.

7. The gas block assembly of claim 6, wherein the driving mechanism is located on an end of the tapered fastener, and wherein an opposite end of the tapered fastener includes an additional section arranged to mate with a groove defined by the barrel.

8. The gas block assembly of claim 7, wherein the groove comprise a V-slot.

9. The gas block assembly of claim 6, wherein the gas block comprises an adjustable gas block that is adjustable using a rotationally actuated gas metering shaft.

10. The gas block assembly of claim 9, wherein a smooth length of the gas metering shaft includes a groove and one or more ring(s) located in the groove to provide a metallic labyrinth seal with a bore of the adjustable gas block.

11. An apparatus, comprising:

an adjustable gas block including:

an ingress port to receive gas expelled from a gas port located on a barrel; and a rotationally actuated gas metering shaft drivable in a threaded section of a bore of the adjustable gas block to at least partially cover the ingress port with the gas metering shaft to restrict a flow of the gas, wherein the gas metering shaft includes a section to form a seal with a smooth section of the bore in a range of selectable positions of the gas metering shaft from maximum gas flow restriction to minimum gas flow restriction, the section of the gas metering shaft including a groove and a gas seal located in the groove;

wherein the bore is continuous such that the smooth section directly transitions to the threaded section;

wherein, when the gas metering shaft is rotated in the threaded section, the seal of the gas seal is maintained until the gas seal reaches the threaded section is reached.

12. The apparatus of claim 11, wherein the gas seal comprises a metallic seal.

13. The apparatus of claim 11, wherein the gas seal comprises a laminar gas seal.

14. The apparatus of claim 11, wherein the gas seal comprises a metallic split ring.

15. A firearm including the apparatus of claim 11.

* * * * *